US007500824B2

(12) United States Patent
Cheng et al.

(10) Patent No.: US 7,500,824 B2
(45) Date of Patent: Mar. 10, 2009

(54) ANGEL WING ABRADABLE SEAL AND SEALING METHOD

(75) Inventors: Yinguo Cheng, Clifton Park, NY (US); Biao Fang, Clifton Park, NY (US); Tara Easter McGovern, Simpsonville, SC (US); Christopher Edward Wolfe, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 347 days.

(21) Appl. No.: 11/507,562

(22) Filed: Aug. 22, 2006

(65) Prior Publication Data

US 2008/0056889 A1 Mar. 6, 2008

(51) Int. Cl.
*F01D 11/00* (2006.01)

(52) U.S. Cl. ..... 415/173.4; 415/174.4; 415/174.5

(58) Field of Classification Search ..... 415/173.4, 415/174.4, 174.5
See application file for complete search history.

(56) References Cited

U.S. PATENT DOCUMENTS 4,309,145 A * 1/1982 Viola ..... 415/173.7
4,422,827 A * 12/1983 Buxe et al. ..... 416/193 A
4,767,267 A * 8/1988 Salt et al. ..... 415/173.7
5,215,435 A * 6/1993 Webb et al. ..... 277/414
5,429,478 A 7/1995 Krizan et al.
5,503,528 A 4/1996 Glezer et al.
5,601,404 A 2/1997 Collins
5,967,745 A * 10/1999 Tomita et al. ..... 415/173.7
6,152,690 A * 11/2000 Tomita et al. ..... 415/173.7
6,189,891 B1 2/2001 Tomita et al.
6,837,676 B2 * 1/2005 Yuri et al. ..... 415/115
7,001,145 B2 2/2006 Couture et al.
7,008,462 B2 3/2006 Fiala
7,025,356 B1 * 4/2006 Cheung et al. ..... 277/415
7,029,232 B2 4/2006 Tuffs et al.
2004/0265120 A1 12/2004 Tuffs et al.
2005/0003172 A1 1/2005 Wheeler et al.
2005/0079050 A1 * 4/2005 Kokusho ..... 415/200
2005/0111967 A1 5/2005 Couture et al.
2005/0123785 A1 6/2005 Sahoo et al.
2005/0155454 A1 7/2005 Fiala et al.
2005/0158572 A1 7/2005 Fiala et al.
2005/0164027 A1 7/2005 Lau et al.

* cited by examiner

*Primary Examiner*—Igor Kershteyn
(74) *Attorney, Agent, or Firm*—Nixon & Vanderhye PC

(57) ABSTRACT

An abradable seal is provided to improve turbine performance by physically reducing the clearance between a flange portion of the nozzle and an opposed angel wing/seal plate member of the bucket. The provision of an abradable seal also mitigates angel wing/seal plate tooth or fin wear by providing for abradable contact without metal to metal hard rub.

19 Claims, 2 Drawing Sheets

ANGEL WING ABRADABLE SEAL AND SEALING METHOD

BACKGROUND OF THE INVENTION

The present invention generally relates to rotary machines such as steam and gas turbines and, more particularly, is concerned with a rotary machine having a seal assembly to control clearance between the shank portion of rotating rotor blades or "buckets" and a radially inner end of a stationary nozzle of the rotary machine.

Steam and gas turbines are used, among other purposes, to power electric generators. Gas turbines are also used, among other purposes, to propel aircraft and ships. A steam turbine has a steam path which typically includes in serial-flow relation, a steam inlet, a turbine, and a steam outlet. A gas turbine has a gas path which typically includes, in serial-flow relation, an air intake or inlet, a compressor, a combustor, a turbine, and a gas outlet or exhaust nozzle. Compressor and turbine sections include at least one circumferential row of rotating buckets. The free ends or tips of the rotating buckets are surrounded by a stator casing. The base or shank portion of the rotating buckets are flanked on upstream and downstream ends by the inner shrouds of stationary blades disposed respectively upstream and downstream of the moving blades.

The efficiency of the turbine depends in part on the radial clearance or gap between the rotor bucket shank portion angel wing tip(s) (seal plate fins), and a sealing structure of the adjacent stationary assembly. If the clearance is too large, excessive valuable cooling air will leak through the gap between the bucket shank and the inner shroud of the stationary blade, decreasing the turbine's efficiency. If the clearance is too small, the angel wing tip(s) will strike the sealing structure of the adjacent stator portions during certain turbine operating conditions.

In this regard, it is known that there are clearance changes during periods of acceleration or deceleration due to changing centrifugal forces on the buckets, due to turbine rotor vibration, and due to relative thermal growth between the rotating rotor and the stationary assembly. During periods of differential centrifugal force, rotor vibration, and thermal growth, the clearance changes can result in severe rubbing of, e.g., the moving bucket tips against the stationary seal structures. Increasing the tip to seal clearance gap reduces the damage due to metal to metal rubbing, but the increase in clearance results in efficiency loss.

BRIEF DESCRIPTION OF THE INVENTION

The invention relates to a structure and method for sealing an interface between rotating and stationary components of a turbine, in particular between the radially inner end portion of a stationary blade assembly and the shank of a rotating bucket. In an example embodiment of the invention an abradable seal material is provided on a surface of one of the facing seal components that define a seal gap between a nozzle inner shroud and the shank of an adjacent rotating bucket of the turbine.

Thus, the invention may be embodied in a turbine comprising: a rotor including an outer surface and at least one bucket extending radially from said outer surface; a stator having at least one stationary nozzle vane and defining a main casing for the rotor; a seal assembly including a flange portion extending in an axial direction of the rotor from a distal end portion of said nozzle vane, and a seal plate member extending in an axial direction of the rotor from said bucket for defining a clearance gap with said flange portion; and an abradable seal material disposed in said clearance gap, on one of said flange portion and said seal plate member, thereby defining a seal gap between said flange portion and said seal plate member.

The invention may also be embodied in a gas turbine assembly comprising: a moving blade assembly disposed on a periphery of a rotating shaft, said moving blade assembly having a platform and including at least two axially projecting angel wing seal structures; a stationary blade assembly disposed adjacent to said moving blade assembly, said stationary blade assembly having at least one flange portion extending in an axial direction of the rotation axis of the rotating shaft for defining a seal gap with a respective one of said angel wing seal structures; an abradable seal material disposed on one of a surface of said flange and a surface said respective one of said angel wing seal structures.

The invention may also be embodied in a method for defining a seal gap at an interface between rotating and stationary components of a turbine comprising: providing a rotor including an outer surface and at least one bucket extending radially away from the outer surface, a seal plate member extending in an axial direction of the rotor from said bucket; providing a stator having at least one nozzle vane and defining a main casing for the rotor, a flange portion extending in an axial direction of the rotor from a distal end portion of said nozzle vane for axially overlapping with said seal plate member and defining a radial clearance gap therewith; and reducing a radial dimension of said clearance gap by providing an abradable material in said seal gap, on one of said flange portion and said seal plate member, thereby to define a seal gap between said flange portion and said seal plate member.

DETAILED DESCRIPTION OF THE INVENTION

Clearance control devices such as abradable seals have been proposed in the past to accommodate rotor to casing clearance changes. See for example U.S. Pat. Nos. 6,340,286, 6,457,552; and Published Application Nos. 2005-0003172, US 2005-0164027 and US 2005-0111967, the disclosure of each of which is incorporated herein by this reference. Such clearance control devices allow the designer to decrease the cold built clearance of the turbine or engine, which decreases unwanted leakage, thus improving the performance and/or efficiency of the turbine or engine.

The invention relates generally to an abradable seal material provided at the interface between a stationary seal component and a rotating portion of the turbine. More particularly, the invention relates to an abradable seal material provided either on a seal gap facing surface of a flange projecting axially from a radially inner end portion of a stationary turbine blade or nozzle assembly, or on the opposed seal gap facing surface of a seal plate projecting axially from a shank portion of a rotating bucket. An example embodiment of the invention is described herein below as incorporated in a gas turbine.

Figure 1:
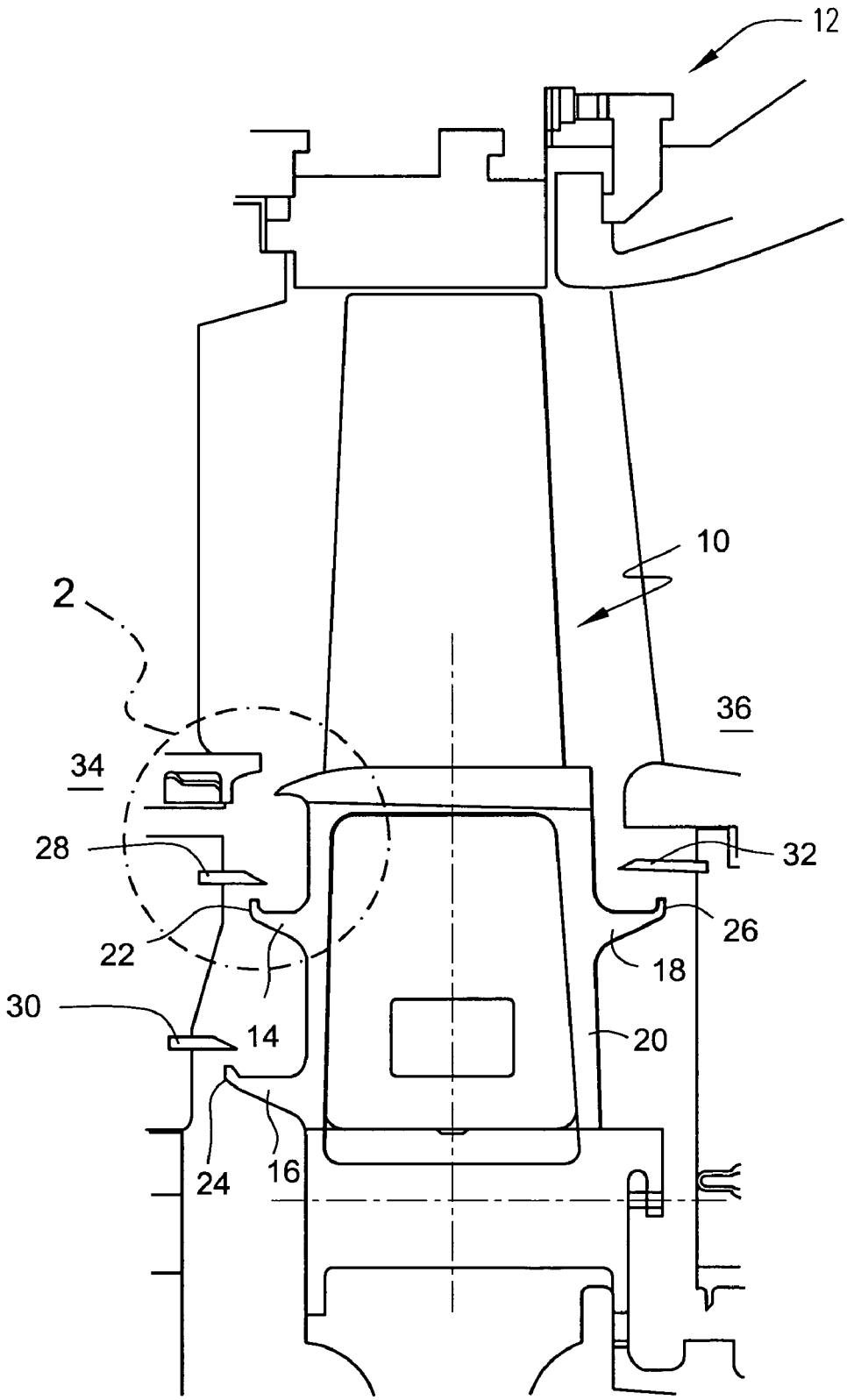
FIG. 1 is a cross-sectional view which shows a seal assembly between a moving blade and a stationary blade in a gas turbine according to an example embodiment of the invention.

FIG. 1 is a cross-sectional view which shows a seal assembly for preventing or limiting cooling air from leaking from between a moving blade (bucket) and a stationary blade (nozzle) of a gas turbine into the high temperature combustion gas passage. The turbine of this example embodiment has a rotor (not shown in detail) rotatable about a center longitudinal axis and a plurality of buckets 10 fixedly mounted on the outer annular surface of the rotor. The buckets are spaced from one another circumferentially about and extend radially outward from the outer annular surface of the rotor to end tips of the buckets. The end tips of each bucket may include an airfoil type shape. An outer casing 12 having a generally annular and cylindrical shape and an inner circumferential surface is stationarily disposed about and spaced radially outwardly from the buckets to define the high temperature gas passage through the turbine.

Reference numerals 14, 16, 18 denote seal plates, so-called angel wings, which extend axially from the upstream and downstream surfaces of the shank portion 20 of the moving bucket and respectively terminate in radially outwardly extending tip(s), teeth or fins 22, 24, 26. Sealing structures or flanges 28, 30, 32, typically referred to as discourager seals, project axially from respective upstream and downstream stationary nozzle assemblies 34, 36 for defining a seal with the angel wings of the moving blade shank 20. These seal assemblies 22/28, 24/30, 26/32 are intended to prevent more than the necessary amount of cooling air from leaking into the high temperature combustion gas passage and being wasted. Conventionally, the gap between angel wing tip 22 and the discourager seal 28 at the radially outer portion of the shank is about 140 mils (3.56 mm) whereas the gap between the radially inner angel wing tip 24 and discourager seal 30 is about 125 mils (3.17 mm). Thus, conventionally, the sealing performance is not always good. Consequently, more than a desired amount of the cooling/sealing air tends to leak into the high temperature combustion gas passage so that the amount of cooling air is increased, thereby inviting deterioration in the performance of the gas turbine.

Figure 2:
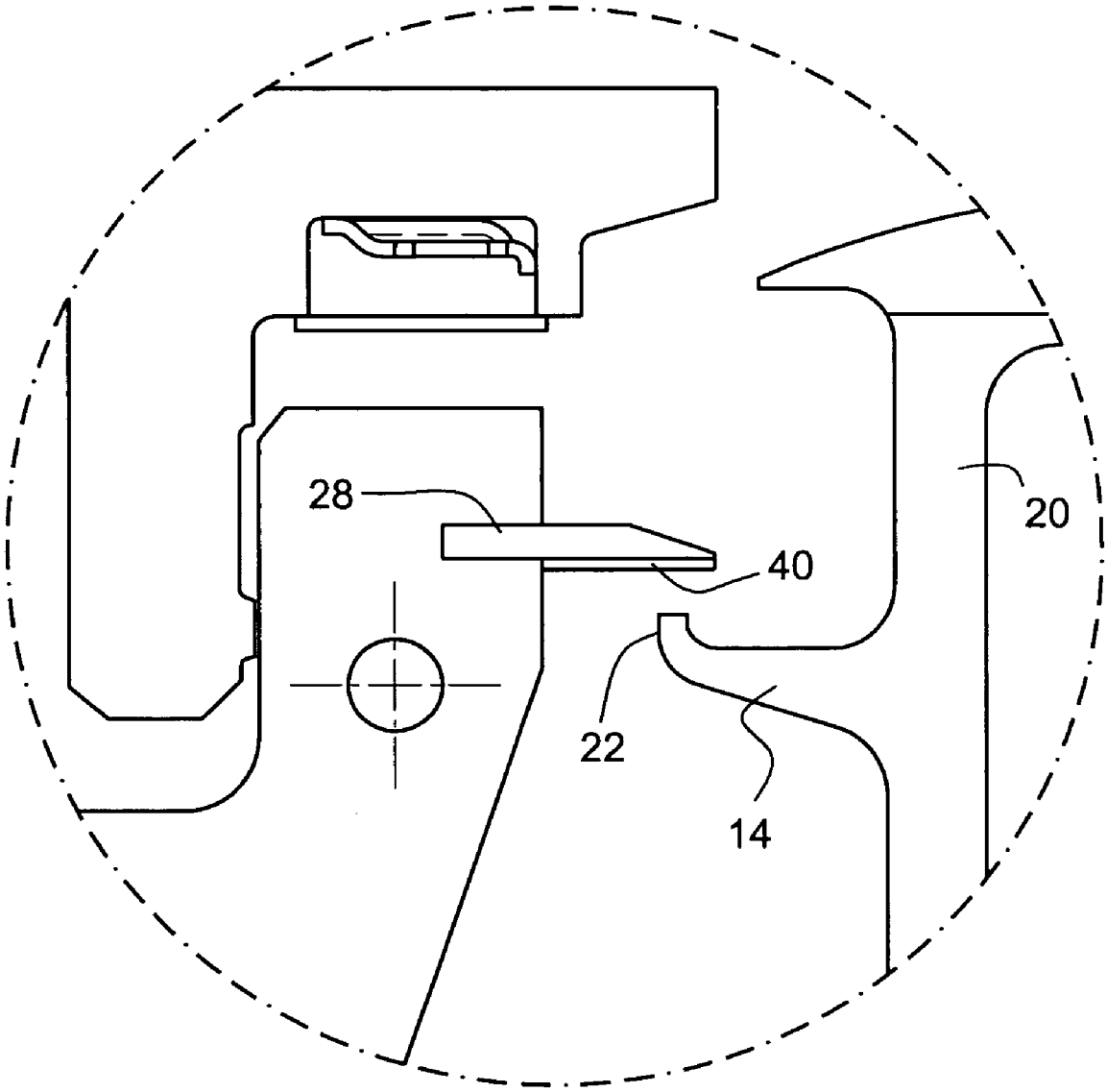
FIG. 2 is an enlarged cross-sectional view showing the interface between a seal structure of the stationary blade and an angel wing tip of the moving blade.

Referring to FIG. 2, according to an example embodiment of the invention, an abradable seal material 40, e.g. of a relatively soft material, is disposed on the radially inner surface of the discourager seal 28 of the stationary blade/nozzle 34 so as to be disposed within the annular gap defined between the inner surface of the discourager seal 28 and the end tip(s) 22 of the angel wing 14 of the bucket shank 20 rotating with the rotor. During periods of differential growth of the rotor and buckets relative to the stationary components, the seal member 40 abrades in response to contact therewith by the tip(s) 22 of the respective angel wing component 14. As such, direct contact between the moving angel wing tip(s) 22 and the discourager seal 28 does not occur, but a localized cavity is defined in the abradable seal material 40. Although in the detailed view of FIG. 2, the abradable seal 40 is illustrated as associated with discourager seal 28, it is to be understood that such an abradable seal material may, in addition or in the alternative, be provided on the radially inner surface of discourager seal 30 and/or 32, as deemed necessary or desirable. Furthermore, although in the illustrated embodiment the angel wings are illustrated as terminating in a tip configured as a single tooth, it is to be understood that this is merely a schematic illustration, and the angel wings may terminate in a single tooth or a plurality of axially spaced teeth.

The abradable seal material provided according to example embodiments of the invention may be metallic or ceramic as deemed appropriate. The abradable seal material is applied directly on the seal surface, the radially inner surface of the discourager seal(s) in the illustrated embodiment. In this regard, the abradable seal material may take the form of an abradable coating, e.g., sprayed on, the seal surface. Examples of abradable coatings which may be applied according to example embodiments of the invention may be found in U.S. Patent Publication Nos. 2005-0164027 and 2005-0003172, the disclosures of each of which are incorporated herein by this reference. The depth of the abradable coating can range from about 10 to 150 mils (about 0.25 to 3.81 mm).

In the illustrated example embodiment, the discourager seals 28,30,32 are designed as replaceable inserts selectively insertable within the stationary blade/nozzle assembly and the abradable material is applied to the radially inner surface thereof. In the alternative, the abradable seal material may be applied to an integrally formed seal flange and/or, in the absence of a seal flange, to the radially inner surface of the nozzle inner shroud, suitably disposed for defining a seal gap with an angel wing tip of the moving bucket. Although, as described hereinabove, the abradable material may be applied to the radially inner surface of one or more of the discourager seals or other seal structure of the nozzle, it is to be understood that, as an alternative, the abradable seal material may be applied to the tip(s) of one or more of the angel wings themselves, although this ultimately results in a lesser wear area.

In an example embodiment, the depth of the abradable seal material is defined as a 50 mil (1.27 mm) coating applied to the stationary discourager seal. As will be appreciated, applying a 50 mil coating to the radially inner surface of the radially outer discourager seal 28 effectively tightens up the clearance between discourager seal 28 and angel wing tip 22 from 140 mils to less than 100 mils. Thus, a 50 mil abradable seal member or coating applied to the stationary discourager seal tightens up the angel wing clearance by over one third. An analysis of flow with the abradable seal material present demonstrates that providing the abradable seal results in about 15-20% reduction in purge flow due to the tightening up of the clearance as above mentioned.

Thus, abradable seals provided according to example embodiments of the invention improve turbine performance by physically reducing the clearance between the bucket angel wing tooth and discourager seal. The reduction in clearance is possible due to the abradable seal's ability to be rubbed without damaging the bucket tooth tips. In this regard, it is expected that the rubbing of the abradable seals on the discouragers is not circumferential but rather the result of pinch point effects. Thus, clearance reduction at the angel wings could provide additional turbine performance gains.

The provision of an abradable seal as described hereinabove also mitigates angel wing tooth wear by providing for abradable contact without metal to metal hard rub, i.e., contact of the angel wing tip and the underlying hard surface of the discourager seal. Thus, the angel wing abradable seals give good clearance reduction and offers additional performance gains in reducing the required purge flow and minimizing bucket angel wing tooth wear and discourager seal damage, thereby increasing their application lives.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a rotor including an outer surface and at least one bucket extending radially from said outer surface;

a stator having at least one stationary nozzle vane and defining a main casing for the rotor;

a seal assembly including a flange portion extending in an axial direction of the rotor from a distal end portion of said nozzle vane, and a seal plate member extending in an axial direction of the rotor from said bucket for defining a clearance gap with said flange portion; and an abradable seal material disposed in said clearance gap, on one of said flange portion and said seal plate member, thereby defining a seal gap between said flange portion and said seal plate member, wherein the abradable seal material comprises a sprayed-on coating of a relatively soft material.

2. A turbine as in claim 1, wherein said at least one flange portion comprises a discourager seal structure secured to said stationary blade assembly.

3. A turbine as in claim 2, wherein said discourager seal structure comprises a replaceable insert selectively insertable into the stationary blade assembly.

4. A turbine as in claim 1, wherein said seal plate member comprises at least one tooth or fin projecting from the surface of said seal plate member towards said flange portion.

5. A turbine as in claim 1, wherein said abradable seal coating is applied to a thickness of between about 10 and 150 mils.

6. A turbine as in claim 5, wherein said coating is applied to a thickness of about 50 mils.

7. A turbine as in claim 5, wherein said abradable seal coating is applied to a radially inner surface of said flange portion.

8. A gas turbine assembly comprising:

a moving blade assembly disposed on a periphery of a rotating shaft, said moving blade assembly having a platform and including at least two axially projecting angel wing seal structures;

a stationary blade assembly disposed adjacent to said moving blade assembly, said stationary blade assembly having at least one flange portion extending in an axial direction of the rotation axis of the rotating shaft for defining a seal gap with a respective one of said angel wing seal structures; and an abradable seal material disposed on one of a surface of said flange and a surface said respective one of said angel wing seal structures, wherein the abradable seal material comprises a sprayed-on coating of a relatively soft material.

9. A gas turbine assembly as in claim 8, wherein said at least one flange portion comprises a discourager seal structure secured to said stationary blade assembly.

10. A gas turbine assembly as in claim 9, wherein said discourager seal structure comprises a replaceable insert selectively insertable into the stationary blade assembly.

11. A gas turbine assembly as in claim 8, wherein said abradable seal coating is applied to a thickness of between about 10 and 150 mils.

12. A gas turbine assembly as in claim 11, wherein said coating is applied to a thickness of about 50 mils.

13. A gas turbine assembly as in claim 11, wherein said abradable seal coating is applied to a radially inner surface of said flange portion.

14. A method for defining a seal gap at an interface between rotating and stationary components of a turbine comprising:

providing a rotor including an outer surface and at least one bucket extending radially away from the outer surface, a seal plate member extending in an axial direction of the rotor from said bucket;

providing a stator having at least one nozzle vane and defining a main casing for the rotor, a flange portion extending in an axial direction of the rotor from a distal end portion of said nozzle vane for axially overlapping with said seal plate member and defining a radial clearance gap therewith; and reducing a radial dimension of said clearance gap by providing an abradable material in said seal gap, on one of said flange portion and said seal plate member, thereby to define a seal gap between said flange portion and said seal plate member, wherein said abradable material is provided by spraying on a coating of a abradable seal material to said surface, said abradable seal material comprising a relatively soft material.

15. A method as in claim 14, wherein said flange portion comprises a discourager seal structure secured to said stationary blade assembly.

16. A method as in claim 15, wherein said discourager seal structure comprises a replaceable insert, and further comprising replacing said discourager seal structure.

17. A method as in claim 14, wherein said coating is applied to a thickness of between about 10 and 150 mils.

18. A gas turbine assembly as in claim 17, wherein said coating is applied to a thickness of about 50 mils.

19. A method as in claim 14, wherein said abradable seal coating is applied to a radially inner surface of said flange portion.

* * * * *